US006769350B2

(12) United States Patent
Hoogen et al.

(10) Patent No.: US 6,769,350 B2
(45) Date of Patent: Aug. 3, 2004

(54) LINEAR PATH SLIDE

(75) Inventors: Norbert Hoogen, Kleve (DE); Dieter Lencer, Wegberg (DE)

(73) Assignee: Heidel GmbH & Co. KG Werkzeug-u. Maschinenfabrikation, Viersen (DE)

( * ) Notice: Subject to any disclaimer, the term of this patent is extended or adjusted under 35 U.S.C. 154(b) by 35 days.

(21) Appl. No.: 10/116,691

(22) Filed: Apr. 4, 2002

(65) Prior Publication Data

US 2002/0185001 A1 Dec. 12, 2002

(30) Foreign Application Priority Data

Apr. 6, 2001 (DE) ..... 201 06 043 U

(51) Int. Cl.[7] ..... F01B 7/04
(52) U.S. Cl. ..... 92/51; 92/152
(58) Field of Search ..... 92/51, 52, 117 R, 92/117 A, 152; 91/169, 207, 216 R, 217

(56) References Cited

U.S. PATENT DOCUMENTS 2,851,994 A 9/1958 Fagge
2,982,257 A 5/1961 Fagge
3,457,840 A * 7/1969 Grimes ..... 92/151
3,485,141 A * 12/1969 Ott et al. ..... 92/151
4,137,828 A 2/1979 Senn
6,244,560 B1 * 6/2001 Johnson ..... 92/151

FOREIGN PATENT DOCUMENTS

DE 9315211 12/1993

* cited by examiner

*Primary Examiner*—F. Daniel Lopez
(74) *Attorney, Agent, or Firm*—Friedrich Kueffner

(57) ABSTRACT

This invention relates to a linear path slide (10) with a slide (26) which is arranged slidingly movable in a housing (12) along a sliding guide (20) and safe against torsion and with a hydraulic driving gear (40) integrated into the slide (26) for a shifting movement of the slide (26), whereby a working piston of the hydraulic driving gear (40) is configured with at least two stages, whereby each stage of the working piston forms a partial hydraulic driving gear (40', 40") of the hydraulic driving gear (40) so that higher actuation forces can thus be realized.

4 Claims, 1 Drawing Sheet

LINEAR PATH SLIDE

BACKGROUND OF THE INVENTION

The present invention relates to a linear path slide with a slide which is arranged slidingly movable in a housing along a sliding guide and safe against torsion and with a hydraulic driving gear integrated into the slide for a shifting movement of the slide.

Linear path slides of the type according to the kind are known. They are used in particular as actuators in different devices for the processing and machining of metallic materials and plastic or plastic composite materials. The functions of these structural components typically include the pressing, forming, stamping, bending, beading, punching, cutting, jointing, jointing pressing as well as the carrying out of feeding functions with special requirements. Particular requirements are made to the properties of linear path slides among which, in particular, a very high energy density, a very high guiding exactitude as well as a very high stiffness against transverse loads and torsion are to be found. Furthermore, linear path slides should be constructed as compact as possible and allow, as standardized basic structural components, a flexible universal range of application. Moreover, properties such as maintenance-freedom during the whole lifetime, a robust construction for the use in polluted environment, the possibility of any fitting position, absolute tightness (for example by overhead mounting) and not least a low-cost production are desirable.

Different configurations of linear path slides are known. Because of the required high energy density, they are preferably hydraulic devices. However, basically the design as a pneumatically driven device is also possible.

From the EP 1 050 685 A2, we know a linear path slide in which a hydraulic driving gear is integrated into the slide for obtaining a compact construction and a reduced volume and thus a reduced weight.

SUMMARY OF THE INVENTION

The aim of this invention is to create a linear path slide of the type according to the kind which can realize high actuation forces by maintaining a compact construction.

According to the invention, this aim is achieved by a linear path slide with the characteristics indicated in claim 1. By the fact that a working piston of the hydraulic driving gear is configured at least with two stages, whereby each stage of the working piston forms a partial hydraulic driving gear of the hydraulic driving gear, it is advantageously reached that an increase of the actuation force of the linear path slide is obtained according to the selected multiple-stage design. The actuation forces applied by the individual partial stages are superimposed and thus result in a higher total actuating force.

Thus, due to such linear path slides, high processing forces are applied by maintaining an exact guiding and a high stiffness against transverse loads, for example for cutting tools.

In a preferred embodiment of the invention, it is provided for that the working piston comprises a guiding element guided slidingly along the housing, guiding element which coaxially encompasses a piston rod fixed with respect to the housing, whereby the guiding element constitutes two inner spaces axially spaced to the piston rod and sealed against each other. Due to such a configuration, it is advantageously reached to use the size available for constituting the partial hydraulic driving gears. In particular, there results then a parallel efficacy of the partial hydraulic driving gears so that the increase of the actuation force of the linear path slide can be obtained in a simple way.

According to a further preferred embodiment, two hydraulic working spaces sealed against each other are respectively configured in each of the inner spaces of the guiding element sealed against each other, whereby these working spaces can be optionally charged with hydraulic oil under pressure. Thus, it is advantageously reached that either the adjusting movement of the linear path slide, or the reset movement of the linear path slide can be hydraulically activated.

Further preferred embodiments of the invention result from the other characteristics indicated in the subclaims.

BRIEF DESCRIPTION OF THE DRAWINGS

The invention will be explained in detail below with an embodiment with reference to the corresponding drawing which shows in FIG. 1 a longitudinal section through a linear path slide.

DETAILED DESCRIPTION OF THE INVENTION

Figure 1:
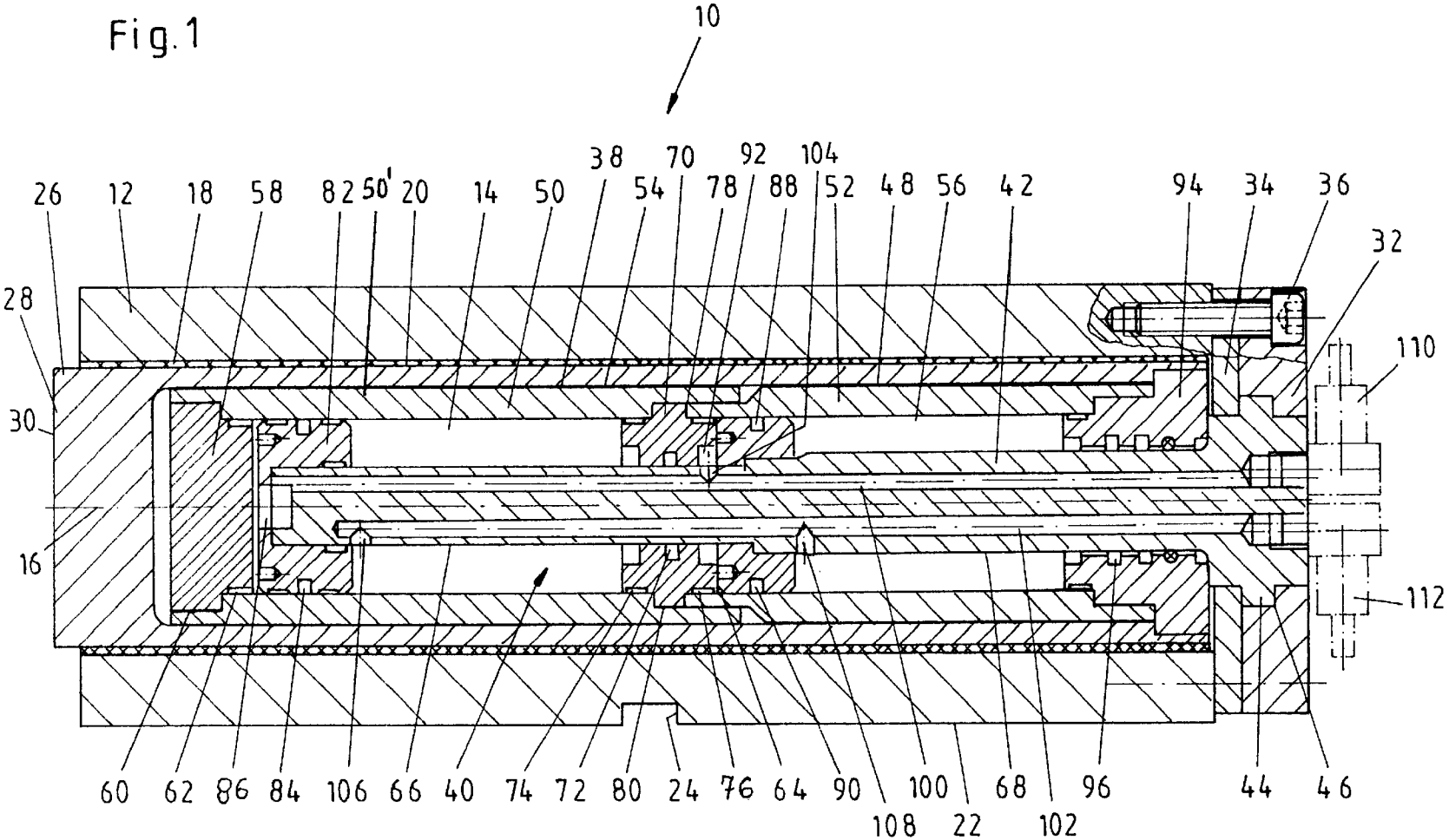

FIG. 1 shows a longitudinal path slide designated as a whole as 10. The longitudinal path slide 10 comprises a housing 12 which constitutes an inner space 14. The inner space 14 is configured symetrically to a longitudinal axis 16. An inner wall 18 of the inner space 14 is provided with a slideway 20 which is preferably produced by a casting method in a known way.

When we consider the housing 12 in cross section, it is formed for example cylindrically, in particular however as a right parallelepiped. Correspondingly, the inner space 14, considered in cross section, has a round or preferably a rectangular cross-sectional area. An outer face 22 of the housing 12 preferably forms a mounting surface and possesses a groove 24 for receiving a feather key or the like which serves for positioning and for absorbing the shifting forces.

A slide 26 which is guided completely free from backlash in the slideway is placed inside the housing 12, thus in the inner space 14. Considered in cross section, the slide 26 possesses a contour which is adapted to the inner space 14, is thus preferably configured as a right parallelepiped. The slide 26 forms a prismatic slide. The slide 26 possesses a section 28, protruding lengthwise over the housing 12, which constitutes an actuation surface 30. The actuation surface 30 serves for example for receiving tools which are not represented in detail, for example cutting tools or the like, or as a pressure or as a pressing surface which is brought into a bearing contact with a subject to be machined.

The forces which the slide 26 must apply in axial direction and resulting transverse forces are within the range of 10 KN to 150 KN, in individual cases also up to 250 KN. Because of an off-center load of the slide 26 during the working process, in particular for cutting tools placed on the slide 26, transverse forces which act onto the slide 26 can be a multiple of the nominal longitudinal force.

The housing 12 is closed at its end opposite the section 28 of the slide 26 by a sealing flange 32. The sealing flange 32 is connected with the housing 12 by intercalating an intermediate plate 34 over connecting means 36. Thus, the inner space 14 becomes a blind opening so that a motion stopper is constituted for the slide 26 by the sealing flange 32 or the intermediate plate 34.

The slide 26 forms for its own part a blind opening 38 which is open in direction of the intermediate plate 34. The blind opening 38 serves for receiving a hydraulic driving gear designated as a whole as 40. The hydraulic driving gear 40 is thus integrated into the slide 26.

The blind opening 38 of the slide 26 forms the cylinder of the hydraulic driving gear which receives a working piston. The working piston comprises a piston rod 42 which engages with an ring shoulder 44 into a ring groove 46 constituted correspondingly by the sealing flange 32 and the intermediate plate 34. The piston rod 42 is thus positioned aligned with the longitudinal axis 16. The piston rod 42 is thus placed fixed, i.e. not movable lengthwise.

The piston rod 42 is coaxially encompassed by a guiding element 48 which constitutes a first section 50 forming a cylinder tube 50' and a second section 52. The sections 50 and 52 have a circumferential backlash of approximately 0.5 mm to the inner wall 54 of the blind opening 38 of the slide 26. A guiding without any backlash is also possible. It comes to the formation of an ring space 56 between the guiding element 48 and the piston rod 42.

The section 50 of the guiding element 48 is closed pressure sealed by a plug 58 at its front side turned to the section 28 of the slide 26. The plug 58 is screwed into the cylinder tube 50', i.e. it is screwed by means of an external thread 60 into an internal thread of the cylinder tube 50'. A gasket 62 which is outlined here is additionally provided.

The sections 50 and 52 of the guiding element 48 are non-positively connected with each other, for example over a thread connection 64. For this purpose, the sections 50 and 52 are provided with respective corresponding recesses at their ends which are turned to each other.

The piston rod 42 possesses a first section 66 with a smaller diameter and a second section 68 with a bigger diameter. A transition piece 70 is placed on the section 66, this transition piece being placed tightly to the piston rod 42 with a gasket 72 and to the guiding element 48 with gaskets 84. Thus, there comes to the constitution of a first inner space 74 and of a second inner space 76 of the ring space 56. The transition piece 70 thus forms a bulkhead wall between the inner spaces 74 and 76. The transition piece 70 engages with a ring shoulder 78 into a corresponding ring recess 80 between the sections 50 and 52 of the guiding element 48. Thus, the guiding element 48 and the transition piece 70 are placed in such a way that they are not movable in relation to each other.

The piston rod 42 carries a first piston 82 fixedly placed thereon which is placed opposite the plug 58. The piston 82 is guided by gaskets 84 on the section 50 of the guiding element 48 so that it comes to the constitution of a hydraulic working space 86 between the piston 82 and the plug 58.

Due to the arrangement of the piston 82 and of the transition piece 70, the inner space 74 also simultaneously forms a hydraulic working space 75.

The piston rod 42 carries a second piston 88 which is also fixedly placed on the piston rod 42. The piston 88 is guided by means of gaskets 90 on the section 52 of the guiding element 48. Thus, there comes to the constitution of a hydraulic working space 92 between the piston 88 and the transition piece 70.

Furthermore, the piston rod 42 is encompassed by a screwed connection 94 which is tightly placed on the piston rod 42 by means of gaskets 96. The screwed connection 94 simultaneously forms a front side seal for the guiding element 48 and the slide 26. Due to the arrangement of the screwed connection 94, the inner space 76 simultaneously also forms a hydraulic working space 77.

The piston rod 42 possesses a first axial bore hole 100 and a second axial bore hole 102. The axial bore hole 100 runs on the one side into the hydraulic working space 86 and over a radial bore hole 104 into the hydraulic working space 92. The axial bore hole 102 runs over a radial bore hole 106 into the hydraulic working space 74 and over a radial bore hole 108 into the hydraulic working space 76. The axial bore holes 100 or 102 are respectively connected with a hydraulic oil connecting flange 110 or 112. The connecting flanges 110 or 112 are connected with not represented hydraulic oil sources.

The linear path slide 10 represented in FIG. 1 shows the following functions.

For drawing out the slide 26, hydraulic oil is set under pressure at the connecting flange 110. Due to the pressure connection over the axial bore hole 100, the pressure builds up in the hydraulic working space 86 and over the radial bore hole 104 additionally in the hydraulic working space 92. Thus, a force of pressure orientated to the left—according to the representation of FIG. 1—is exerted onto the plug 58 and the transition piece 70. An actuation force resulting herefrom depends on the pressure head and on the pressure loaded surface. Thus, there results the surface of the plug 58 which is turned to the hydraulic working space 86 as pressure loaded surface and the surface of the transition piece 70 which is turned to the hydraulic working space 92 as pressure loaded surface. These pressure loaded surfaces add up to a whole pressure loaded surface so that, compared with the known linear path slides, a higher actuation force can be applied. However, the surface of the transition piece 70 is not completely integrated into the increase of force but must be reduced by the cross section of the section 66 of the piston rod 42.

The force which is building up is transferred over the plug 58 and the guiding element 48 to the slide 26 so that the slide is submitted to a corresponding axial adjusting movement along the longitudinal axis 16. The maximal stroke of the slide 26 is predetermined here by the axial distance of the piston 82 to the transition piece 70 or of the piston 88 to the screwed connection 94.

A reset movement of the slide 26 is possible in that hydraulic oil under pressure is applied to the connecting flange 112. This pressure builds up over the axial bore hole 102 and the radial bore holes 106 and 108 in the hydraulic working spaces 75 and 77. A restoring force orientated to the right—according to the representation in FIG. 1—builds up according to the pressure loaded surface of the transition piece 70 which is turned to the hydraulic working space 75 and to the pressure loaded surface of the screwed connection 94 which is turned to the hydraulic working space 77, whereby this restoring force moves the slide 26 into the housing 12. The screwed connection 94 constitutes simultaneously with the ring shoulder 44 of the piston rod 42 a reset stopper.

It is clear that, due to the arrangement of two pistons 82 or 88 on the piston rod 42—by intercalating a transition piece 70—the hydraulic driving gear 40 is configured with two stages so that there results an increase of the pressure loaded surface and thus an increase of the actuation force. The piston 82 constitutes in connection with the hydraulic working space 86 and with the section 50 of the guiding element 48 a first partial hydraulic driving gear 40', while the piston 88 in connection with the transition piece 70 and the guiding element 48 constitutes a second partial hydraulic driving gear 40".

With respect to the further advantages of the linear path slide 10, in particular with respect to its compact construction and to the fundamental advantages of a hydraulic driving gear 40 integrated into the housing 12, we refer to the EP 1 050 685 A2, the content of which is made herewith to the content of disclosure of this invention.

The invention self-evidently is not limited to the represented embodiment. So, multiple stage constructions (with more than two stages) are also conceivable. It comes then either to a reduction of the maximal stroke of the linear path slide, or to a bigger axial extension of the linear path slide.

| List of reference numerals | |
|---|---|
| 10 | Linear path slide |
| 12 | Housing |
| 14 | Inner space |
| 16 | Longitudinal axis |
| 18 | Inner wall |
| 20 | Slideway |
| 22 | Outer face |
| 24 | Groove |
| 26 | Slide |
| 28 | Section |
| 30 | Actuation surface |
| 32 | Sealing flange |
| 34 | Intermediate plate |
| 36 | Connecting means |
| 38 | Blind opening |
| 40 | Hydraulic driving gear |
| 40' | First partial hydraulic driving gear |
| 40" | Second partial hydraulic driving gear |
| 42 | Piston rod |
| 44 | Ring shoulder |
| 46 | Ring groove |
| 48 | Guiding element |
| 50 | First section |
| 52 | Second section |
| 54 | Inner wall |
| 56 | Ring space |
| 58 | Plug |
| 60 | External thread |
| 62 | Gasket |
| 64 | Threaded connection |
| 66 | First section |
| 68 | Second section |
| 70 | Transition piece |
| 72 | Gasket |
| 74 | First inner space |
| 75 | Hydraulic working space |
| 76 | Second inner space |
| 77 | Hydraulic working space |
| 78 | Ring shoulder |
| 80 | Ring recess |
| 82 | Piston |
| 84 | Gaskets |
| 86 | Hydraulic working space |
| 88 | Piston |
| 90 | Gaskets |
| 92 | Hydraulic working space |
| 94 | Screwed connection |
| 96 | Gaskets |
| 100 | First axial bore hole |
| 102 | Second axial bore hole |

-continued

| List of reference numerals | |
|---|---|
| 104 | Radial bore hole |
| 106 | Radial bore hole |
| 108 | Radial bore hole |
| 110 | Connecting flange |
| 112 | Connecting flange |

What is claimed is:

1. A linear path slide, comprising: a housing; a sliding guide arranged in the housing; a slide arranged to beslidingly movable in the housing along the sliding guide and prevented from rotation; and a hydraulic driving gear integrated into the slide for a shifting movement of the slide, the hydraulic driving gear having a working piston configured with two stages, whereby each stage of the working piston forms a partial hydraulic driving gear of the hydraulic driving gear, the working piston including a piston rod fixed with respect to the housing and a guiding element guided slidingly along the housing, the guiding element coaxially encompassing the piston rod, the guiding element forms two inner spaces axially spaced to the piston rod and sealed against each other, the guiding element is closed and pressure sealed at one end by a plug and at another end by a screwed connection, and has a transition piece that forms the inner spaces, the guiding element has two sections between which the transition piece is held, the piston rod has a first, smaller diameter section and a second, larger diameter section, the transition piece being arranged in the first section, the transition piece being placed tightly to the piston rod and the guiding element by gaskets so as to form a first of the inner spaces and a second of the inner spaces, the sections of the guiding element each have a circumferential backlash to an inner wall of a blind opening in the slide, the guiding element being positioned together with the plug, the transition piece and the screwed connection to be movable lengthwise with respect to the piston rod, the piston rod carries a first piston placed in a first of the inner spaces and a second piston placed in a second of the inner spaces so as to divide the inner spaces into hydraulic working spaces.

2. A linear path slide according to claim 1, wherein the sections have a circumferential backlash of 0.5 mm.

3. A linear path slide according to claim 1, wherein the piston rod has a first axial bore hole that is connected with a first hydraulic connecting flange and runs into the hydraulic working spaces.

4. A linear path slide according to claim 3, wherein the piston rod has a second axial bore hole that is connected with a second hydraulic connecting flange and runs into the hydraulic working spaces.

* * * * *